United States Patent [19]

Minialoff et al.

[11] Patent Number: 4,597,229

[45] Date of Patent: Jul. 1, 1986

[54] PRESSURE RELIEF WALL ASSEMBLY

[75] Inventors: Joseph M. Minialoff, 25 Edgehill Rd., Islington, Ontario, Canada, M9A 4N1; Gerrard O. Minialoff, Kleinberg; Thomas C. McCavour, Islington, both of Canada

[73] Assignee: Joseph M. Minialoff, Toronto, Canada

[21] Appl. No.: 617,043

[22] Filed: Jun. 4, 1984

[30] Foreign Application Priority Data

Jun. 20, 1983 [CA] Canada ..... 430751

[51] Int. Cl.[4] ..... E04H 9/00

[52] U.S. Cl. ..... 52/1; 52/98

[58] Field of Search ..... 52/1, 404, 408, 98, 52/732, 713

[56] References Cited

U.S. PATENT DOCUMENTS

| | | | |
|---|---|---|---|
| 2,989,786 | 6/1961 | Cuss | 52/222 |
| 3,807,106 | 4/1974 | Reinhardt et al. | 52/98 |
| 3,998,016 | 12/1976 | Ting | 52/1 X |
| 4,050,204 | 9/1977 | Scott | 52/98 X |
| 4,094,108 | 6/1978 | Scott | 52/98 X |
| 4,346,538 | 8/1982 | Ting | 52/98 X |
| 4,413,458 | 11/1983 | Ting | 52/732 X |

*Primary Examiner*—Carl D. Friedman

*Assistant Examiner*—Creighton Smith

*Attorney, Agent, or Firm*—Rogers, Bereskin & Parr

[57] ABSTRACT

A pressure relief wall assembly has a liner panel and first and second exterior panels. A first portion or end of the liner panel is secured to one part of the frame. A second portion or end of the liner panel is releasably fastened to another part of the frame, by a plurality of first elements, which elements fail when an excess pressure is applied to either side of the wall assembly. A first end or portion of the first exterior panel is secured to the one part of the frame, and a second end portion of the first exterior panel is secured to the liner panel, for example, at a location midway between the two parts of the frame. The second exterior panel has a first portion secured to the other part of the frame. A second, end portion of the second exterior panel is releasably fastened to the liner panel or to the first exterior panel by a plurality of second elements, which fail when excess pressure is applied to the assembly. In response to excess pressure, the first and second elements fail. The liner panel and the first exterior panel deflect, while remaining attached to the one part of the frame. The second exterior panel remains attached to the other part of the frame, but becomes detached from the other panels. It also deflects, so that the excess pressure is released and no excessive loads are applied to the frame.

14 Claims, 13 Drawing Figures

PRESSURE RELIEF WALL ASSEMBLY

This invention relates to a pressure relief wall assembly. This invention more particularly but not exclusively relates to a pressure relief wall assembly for large structures, such as generating stations.

Such a pressure relief assembly is intended to relieve the pressure on the primary framing of a structure created by abnormal conditions, while simultaneously ensuring that no airborne missiles or debris are released. The abnormal conditions could be an explosion within or outside a building, which blows the wall inwards or outwards, or extreme weather conditions, e.g. a tornado, which might blow a wall inwards or outwards.

The pressure relief assembly of the present invention is sometimes required for large buildings, such as electricity generating stations. It enables the main structure and foundations to be designed to withstand only normal loads and the release load for the pressure relief wall system. The main structure and foundation do not have to be capable of withstanding the load applied by such abnormal conditions as those outlined above.

According to the present invention, there is provided a pressure relief wall assembly for mounting on a frame comprising a first, central support, and two second supports located on either side of the first, central support, the pressure relief wall assembly comprising:

wherein the liner and exterior panels and the fastening means are subtantially symmetrical about the first, central support;

a liner panel having first and second end portions, and being secured at a central portion thereof to the first, central support;

respective first fastening means for the end portions of the liner panel, each of which first fastening means releaseably fastens a respective end portion of the liner panel to a corresponding second support, which first means in the use fail when a predetermined excess pressure is applied to either side of the wall assembly;

a first exterior panel, which is secured at a central portion thereof to the first, central support and which includes first and second end portions, with the first end portion secured to the liner panel between the first end and central portions thereof and with the second end portion of the first exterior panel secured to the liner panel between the second end and central portions thereof;

two second exterior panels, each of which is secured to a respective second support and includes a respective free end portion;

two second fastening means, each of which releasably fastens a free end portion of a respective second exterior panel to one of the liner panel and a respective end portion of the first exterior panel, which second fastening means fail in use, when a predetermined excess pressure is applied to either side of the wall assembly;

whereby, in use, in response to an excess pressure applied to either side of the wall assembly, the liner panel and the first exterior panel are released from the second support and the second exterior panels, and deflect symmetrically about the first, central support, and the second exterior panels deflect around the second supports.

The pressure relief wall assembly according to the present invention provides a break in the exterior panel. This enables even relatively short spans to be constructed so that they fail at a predetermined pressure.

Previously, it was difficult, if not impossible, to make short spans fail at a required pressure due to the strength of the exterior panel. The pressure relief wall assembly of the present invention can, effectively provide a break in the exterior panel midway between supporting elements of the frame. This break enables the assembly to be designed for a required failure or release pressure, even for short spans. At the same time, exterior panels of a relatively rigid cross-section can be used in order to keep usual in service deflections within required limits.

The pressure relief wall system will blow-in or blow-out at predetermined release pressures. The blow-in and blow-out release pressures may be equal or of different magnitudes.

The wall system can be made so as to deflect in or deflect out within predetermined limits at predetermined loads.

Typically, the pressure relief is achieved by a two stage release system. The load for each stage can be controlled. In a preferred embodiment, stage one release includes the connection of the liner panel to a girt or part of the frame using a riveted release assembly. The release load can be controlled by varying the size, spacing and material of the rivets. Stage two release includes the connection of the exterior panel to the liner panel and the girts using subgirts installed at a predetermined spacing. A riveted release subgirt or member and an exterior panel splice can be located at an intermediate location between the girts or frame parts. The release load can be controlled by varying the configuration and thickness of the profile, and by varying the size, spacing and material of a riveted release subgirt.

The riveted release subgirt assembly can comprise a U-shaped or J-shaped member, and an L-shaped member. The second, end portion of the first exterior panel is secured to the liner panel by the U-shaped or J-shaped member, which is located between and spaces apart the first exterior panel and the liner panel. The L-shaped member is secured to the second end portion of the second exterior panel, and is releasably fastened to the U-shaped or J-shaped member by the second elements. In this construction, first and second elements comprise rivets.

This arrangement ensures that, when failure occurs in use, the liner panel and the first exterior panel remain secure to one part of girt of the frame, together with the U-shaped or J-shaped member. Similarly, the second exterior panel together with the L-shaped member remain secure to another part or girt of the frame.

For a single span construction, the respective first portion of each of the first and second exterior panels is provided at an end of the respective exterior panel, opposite its end portion. Similarly, the first and second portions of the liner panel are preferably provided at the ends of the liner panel.

For the single span construction, at a predetermined blow-out pressure, the single span liner panel and the first and second exterior panels bend outwards. The first elements fail in tension, to release the liner panel from the other part of the frame. The wall assembly then continues to deflect, until the release assembly at the junctions between the first and second exterior panels releases, due to the second elements failing in combined tension and shear. The wall assembly then blows out with the liner panel and the first exterior panel remaining attached to the one part or girt of the frame, whilst the second exterior panel remains attached to the second part or girt of the frame at the other end of the pressure relief wall assembly.

At a predetermined blow-in pressure, the single span liner and exterior panels bend in. The first elements or rivets between the liner panel and the second part or girt of the frame again release first and fail in shear. The wall assembly continues to deflect and the release system between the first and second exterior panels releases or fails, due to the second elements or rivets failing in combined tension and shear. The wall system is free to blow in, with the liner panel and the first exterior panel remaining secured to the first part or girt of the frame at one end, whilst at the other end of the pressure relief wall assembly, the second exterior panel remains attached to the other part or girt of the frame.

For a two span construction, the pressure relief wall assembly is mounted on a frame including a third part or girt. The one part or girt of the frame is then located between the other and third parts or girts of the frame. The liner panel now includes a third, end portion, and the second portion of the liner panel is provided at an end opposite the third end, portion with the first portion of the liner panel located centrally between the second and third end portions. The first elements releasably fasten the second and third, end portions of the liner panel to the other and third parts or girts of the frame respectively. The first exterior panel is provided with a third, end portion, and its first portion is provided centrally between its second and third end portions. The second and third, end portions of the first exterior panel are now secured to the liner panel. A third exterior panel is provided, which has a first portion and a second, end portion spaced from the first end portion. The first portion of the third exterior panel is, in use, secured to the third part or girt of the frame. The second elements now releasably fasten the second end portions of the second and third exterior panels to the liner panel or to the second and third end portions respectively of the first exterior panel.

At a predetermined blow out pressure, the double span wall assembly bends outwards. The first elements at either end of the liner panel fail first in tension, to release the second and third end portions of the liner panel. The wall assembly continues to deflect until the second elements fail in combined tension and shear, to release the second and third exterior panels. The wall assembly then blows out, with the liner panel and the first exterior panel forming a generally V-shaped, whilst remaining attached to the one part or girt of the frame at the center. Similarly, the second and third exterior panels remained attached to the frame, and blow outwards.

At a predetermined blow in pressure, the pressure relief wall assembly bends in. The first elements fail first in shear, thereby releasing the ends of the liner panel. The wall assembly continues to deflect under the applied pressure, until the second elements fail, to release the second and third exterior panels from the liner panel. The wall assembly then blows in, with the liner panel and the first exterior panel forming a W-shape, whilst remaining attached to the one part or girt of the frame. Similarly, the second and third exterior panels deflect inwards whilst remaining attached to the frame. This construction can be used for short span constructions, even when relatively stiff exterior panel sections are used. By providing a break between the first and second exterior panels between adjacent parts or girts of the frame, the strength, and in particular the bending strength of the exterior panel is considerably reduced at the joints between these two exterior panels. This enables even short spans to behave in a desired manner.

For a better understanding of the present invention, and to show more clearly how it may be carried into effect, reference will now be made by way of example, to the accompanying drawings which shown an embodiment of the present invention and in which.

Figure 10:
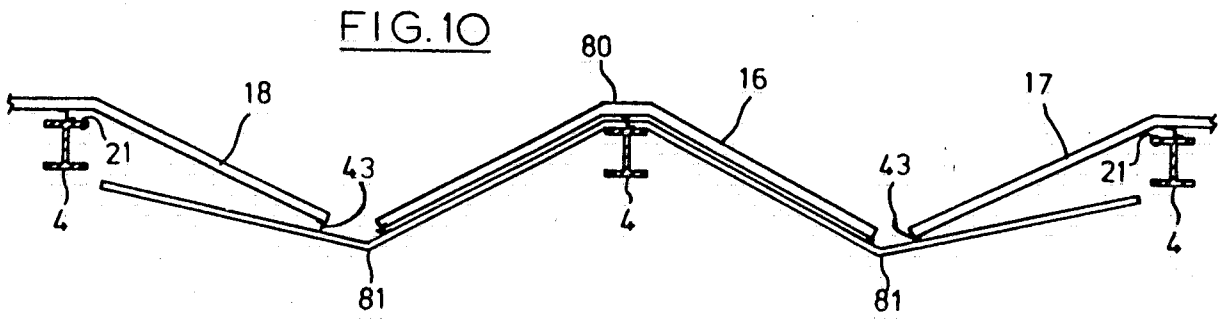
Figure 11:
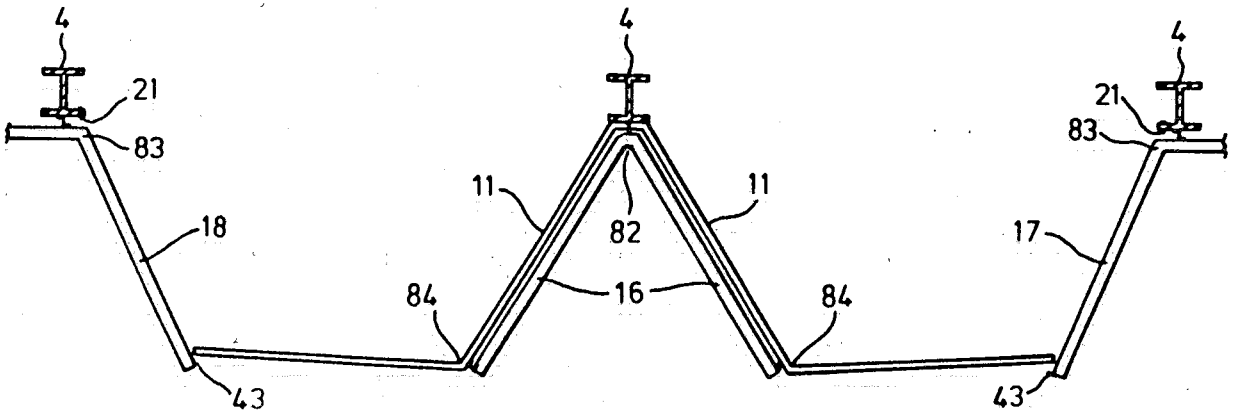
Figure 12:
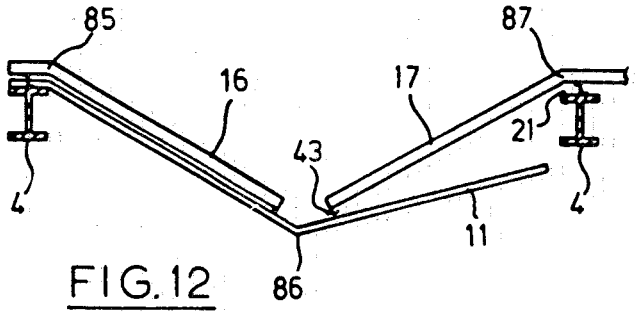
Figure 13:
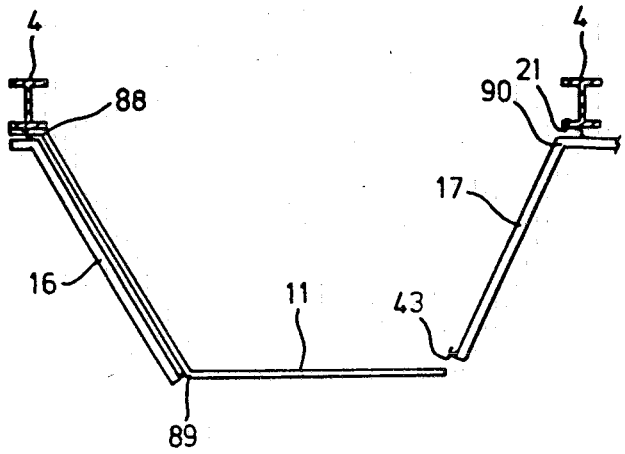

FIGS. 10 and 11 shown the failure mechanism, for a double span in blow-in and blow-out modes;

FIGS. 12 and 13 shows the failure mechanism, for a single span in blow-in and blow-out modes.

Figure 1:
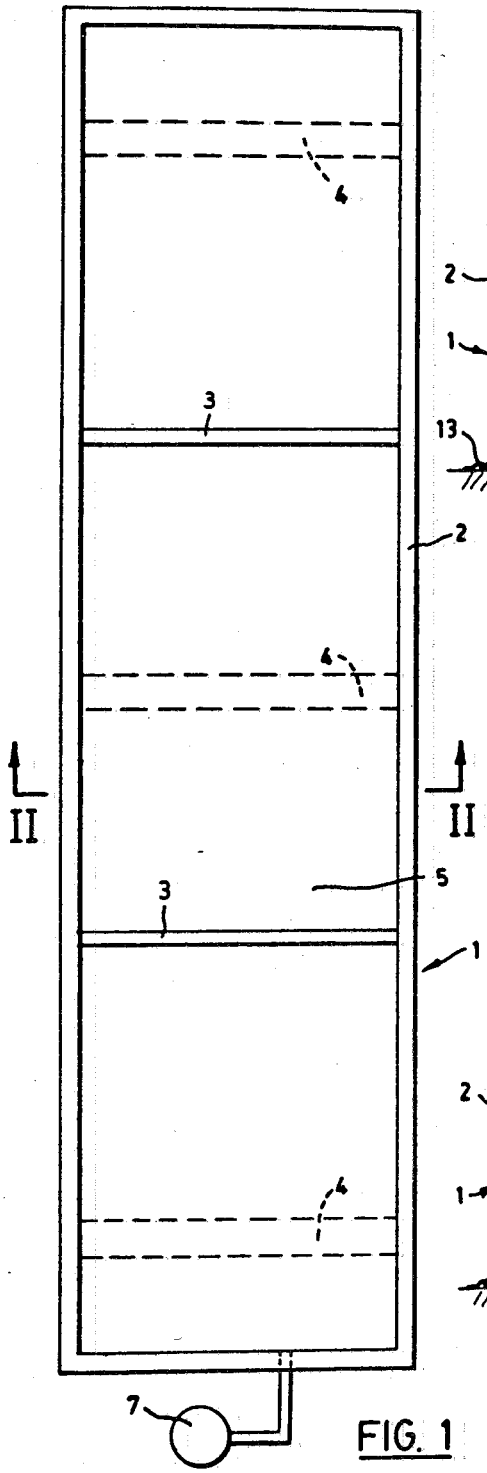
FIG. 1 shows a plan view of a double panel assembly according to the present invention in a test box.
Figure 3:
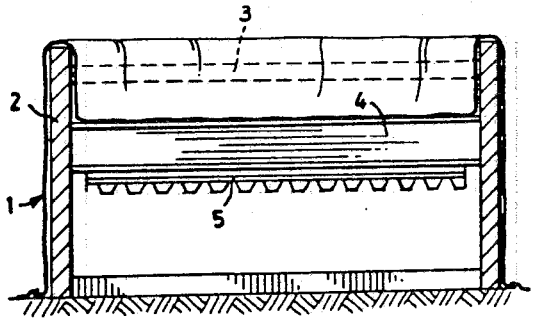
FIG. 3 shows a cross-section similar to FIG. 2, for a blow-out mode.

FIG. 1 shows a vacuum test box 1, which comprises a rectangular body 2 embraced with wooden struts 3. Structural steel supports 4, which are only shown in outline in FIG. 1, simulate part of the steel frame work of a building. A pressure relief wall apparatus or panel 5 is secured to the steel supports 4, with its normal vertical axis disposed horizontally and lengthwise along the test box 1. For a blow-in test, the pressure relief wall apparatus 5 is secured on top of the steel supports 4, with its exterior surface uppermost. When a vacuum is created in the test box 1 below the pressure relief wall apparatus 5, atmospheric pressure serves to provide the necessary external pressure on the apparatus. For a blow-out test, the pressure relief wall apparatus 5 is mounted as shown in FIG. 3. The apparatus is then secured below the steel supports 4, with its usual exterior surface at the bottom. Again, upon evacuating the test box 1, atmospheric pressure serves to deflect the pressure relief wall apparatus 5 downwards. As shown diagramatically in FIG. 1, a vacuum pump 7 is provided for the test box 1.

Figure 2:
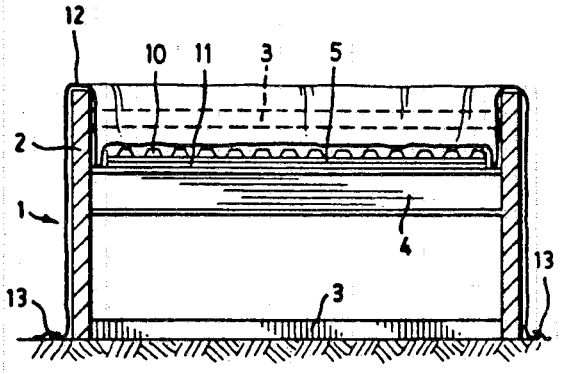
FIG. 2 shows a section along the line II—II of FIG. 1, for a blow-in mode.

As shown in FIG. 2, the wall apparatus or panel comprises exterior panels 10, and an inner liner panel 11. For test purposes, a polythene sheet 12 is laid over the test box 1, and the test panel 5 and is taped to the floor at 13.

Figure 4:
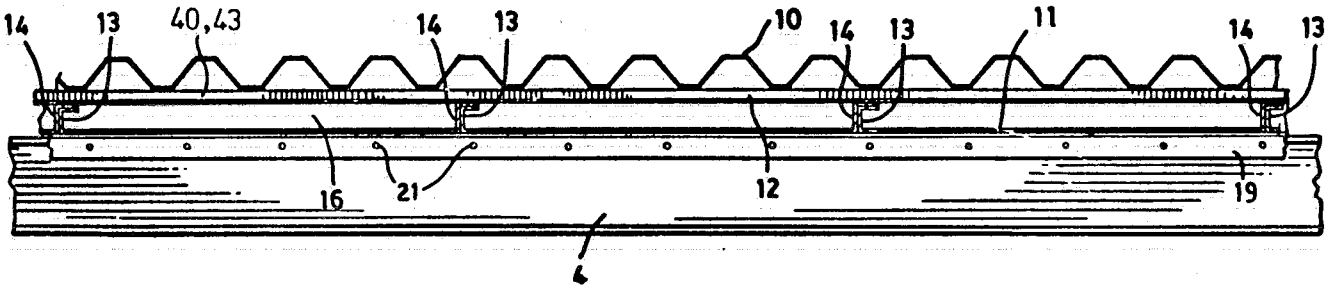
FIG. 4 shows on a large scale part of the section of FIG. 2.

FIG. 4 shows detail of the panel assembly 5. The exterior panels 10 are corrugated. In normal use the corrugations extends vertically, but in the test box 1 they are arranged horizontally. In FIG. 4, three liner panels 11 are shown. Each panel 11 has a C-shaped portion 13 along its left-hand edge and a corresponding Z-shaped portion 14 along its right-hand edge. These portions 13 and 14 enable adjacent liner panels 13 to be coupled along their adjacent edges. Transverse sub-girts or members extend transversely of the exterior and liner panels 10, 11, and are generally denoted 40, 43. (See FIG. 9).

Figure 5:
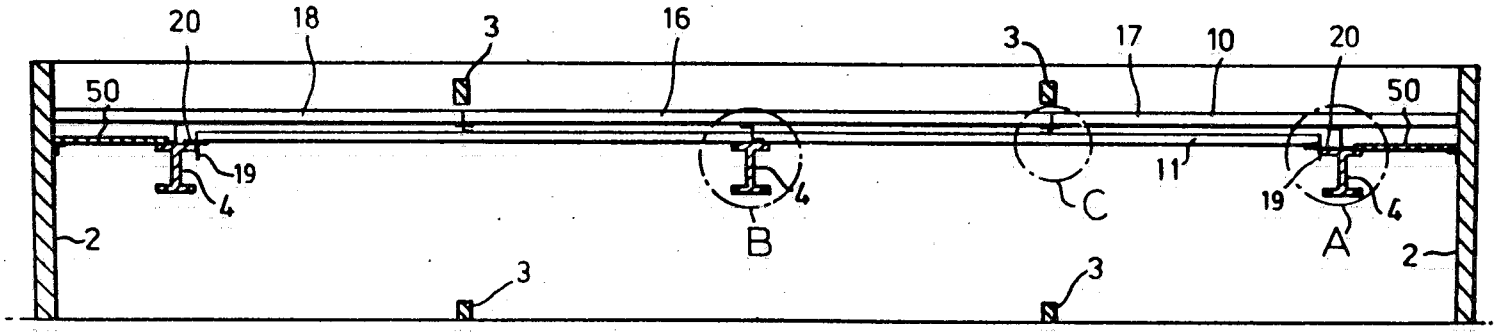
FIG. 5 shows a section, normal to the section of FIGS. 2 and 4, of the double span assembly in the test box.
Figure 6:
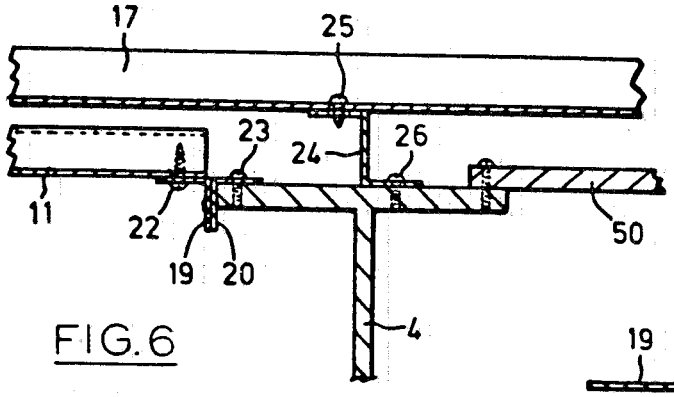
FIG. 6 shows on an enlarged scale part A of FIG. 5.
Figure 7:
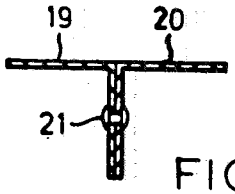
FIG. 7 shows on an enlarged scale part of FIG. 6.

With reference to FIGS. 5 and 6, each end of the assembly is secured to a respective support 4, and FIG. 6 shows the right right hand end in detail. A first L-shaped member 19 is secured by screws 22 to the liner panel 11, and a second L-shaped member 20 is secured by screws 23 to the steel support 4. The two L-shaped members 19, 20 are secured together by rivets 21. For a double span construction, first, second and third exterior panels 16, 17 and 18 are provided. In FIG. 6 a first end portion of the second exterior panel 17 is shown. This first end portion is secured by screws 25 to a Z-shaped member 24, which in turn is secured by screws 26 to the steel support 4.

Figure 8:
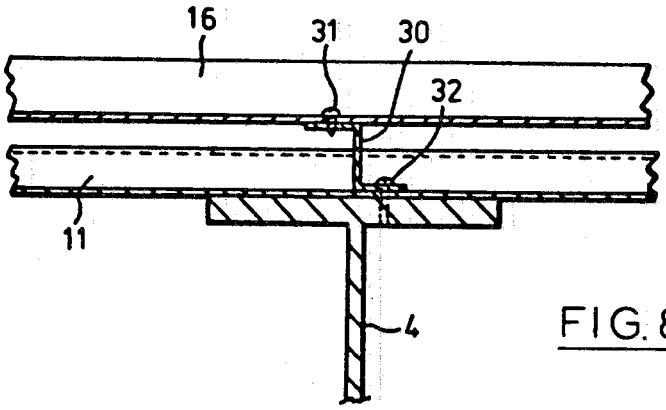
FIG. 8 shows on an enlarged scale part B of FIG. 5.

With reference to FIGS. 5 and 8, the first and central exterior panel 16 is secured to a Z-shaped member 30 by means of screws 31. The Z-shaped member 30 in turn is secured by screws 32 to a steel support 4. The Z-shaped member 30 bridges the liner panels 11 and their connecting portions 13, 14.

Figure 9:
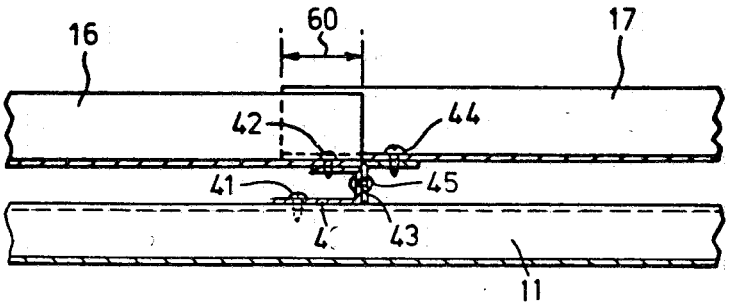
FIG. 9 shows on an enlarged scale part C of FIG. 5.

As shown in FIG. 5, on the left-hand side of the double span construction shown, there is a third exterior panel 18, corresponding to the second exterior panel 17. FIG. 9 shows a detail of the connection between the first exterior panel 16 and the second exterior panel 17; the connections between the first and third exterior panels 16, 18 are similar. A U-shaped or J-shaped member 40 is provided between the liner panels 11 and the third exterior panel 18. This member 40 can either extend across the top of the sections 13, 14 of the liner panels 11, or it can be a wider section which is secured to the main portions of the panels 11 and bridges the sections 13, 14 of the panels 11. As shown in FIG. 9, the U-shaped member is secured by screws 41 to the tops of the C-shaped sections 13 and the Z-shaped sections 14. Similarly, screws 42 secure the other side of the U-shaped member 40 to the third exterior panel 18. An L-shaped member 43 is secured by screws 44 to an end portion of the first exterior panel 16. Rivets 45 secure the U-shape member 40 and the L-shaped member 43 together. Preferably, in this embodiment, the overlap 60 between the first and third exterior panels 16, 18 is at least 50 mm.

The different types of behavior for both single and double-span constructions in both blow-in and blow-out modes will now be described, with reference to FIGS. 10–13.

The behavior of a double span construction in a blow-in mode is shown in FIG. 10. As the pressure differential across the wall assembly increases, the load on the rivets 21 at either end increases. Eventually, the rivets 21 fail in shear. This permits the ends of the liner panels 11 to pull away from the end steel supports 4, as shown in FIG. 10. The wall assembly then continues to deflect, until the load on the joints between the first exterior panel 16 and the second and third exterior panels 17, 18 becomes too great. Then, the rivets 45 fail. This permits separation between the first exterior panel 16 and the liner panel 11 on the one hand, and the second and third exterior panels 17, 18 on the other hand. Consequently a plastic hinge 80 develops in the centre in the first exterior panel 16 and in the liner panels 11 and plastic hinges 81 also develop in the liner panels 11. The liner panels 11 and the first exterior panel 16 blow inwards forming a W-shape, whilst still remaining attached to a central steel support 4. The second and third exterior panel 17, 18 remain attached to the end steel supports 4, and deflect inwards, as indicated in FIG. 10.

For the double span, in a blow-out mode FIG. 11, when the pressure differential exceeds a pre-determined value, the rivets 21 fail in tension. This again permits release of the ends of the liner panel 11 from the end steel supports 4. Again, after further deflection of the wall assembly, separation of the second and third exterior panels 17 and 18 occurs, due to failure of the rivets 45 in combined tension and shear. Consequently, the first exterior panel 16 and the liner panels 11 deflect outwards with a plastic hinge developing at 82, where the first exterior panel 16 and the liner panels 11 are secured to the central steel support 4. Plastic hinges also develop in the liner panels 11 at 84. Again, further plastic hinges 83 develop in the second and third exterior panels adjacent the end steel supports 4, so that the second and third exterior panels 17 and 18 deflect outwards.

The behavior of a single span is similar. In the blow-in mode, shown in FIG. 12, the pressure differential across the single span increases until the rivets 21 fail. The wall panel assembly continues to deflect, and plastic hinges develop at 85 and 86. After further deflection, the rivets 45 fail, to release the second exterior panel 17 from the first exterior panel 16. The first exterior panel 16 and the liner panel 11 now deflect inwards on one side, whilst the second exterior panel 17 deflects inwards on the other side with a plastic hinge developing at 87.

With reference to FIG. 13, in the blow-out mode, the wall panel assembly deflects until the rivets 21 fail, to release the liner panel 11 from the right-hand steel support 4. After further deflection, the rivets 45 combine in tension and shear. Further deflection causes a plastic hinge 89 to form in the liner panel 11, and a plastic hinge 88 to form in the first exterior panel 16 and in the liner panel 11. A plastic hinge 90 is also formed in the second exterior panel 17 adjacent its support 4.

We claim:

1. A pressure relief wall assembly for mounting on a frame comprising a first central support, and two second supports located on either side of the first support, the pressure relief wall assembly comprising:

a liner panel having first and second end portions, and being secured at a central portion thereof to the first, central support;

respective first fastening means for end portions of the liner panel, each of which first fastening means releasably fastens one respective end portion of the liner panel to a corresponding second support, which first fastening means in use fail when a predetermined excess pressure is applied to either side of the wall assembly;

a first exterior panel, which is secured at a central portions thereof to the first, central support, and which includes first and second end portions, with the first end portion secured to the liner panel between the first end and central portions thereof, and with the second end portion of the first exterior panel secured to the liner panel between the second end and central portions thereof;

two second exterior panels, each of which is secured to a respective second support and includes a respective free end portion;

two second fastening means, each of which releasably fastens said respective free end portion of a respective second exterior panel to one of the liner panel and a respective end portion of the first exterior panel, which second fastening means fail in use when a predetermined excess pressure is applied to either side of the wall assembly;

wherein in the liner and exterior panels and the fastening means are substantially symmetrical about the first, central support;

whereby, in use, in response to an excess pressure applied to either side of the wall assembly, the liner panel and the first exterior panel are released from the second support and the second exterior panel, and deflect symmetrically about the first, central support, and the second exterior panels deflect around the second supports.

2. A wall assembly as claimed in claim 1, wherein ends of the first exterior panel are secured by subgirts to the liner panel.

3. A wall assembly as claimed in claim 2, wherein the central portion of the first exterior panel is secured to a Z-section member, which, in use, is secured to a central support of a frame, with the liner panel therebetween.

4. A wall assembly as claimed in claim 2, wherein the second exterior panels are secured to Z-section members, which, in use, are secured to second supports of a frame.

5. A wall assembly as claimed in claim 2, wherein the sub-grits comprise U-section members, each of which has a pair of side limbs, with one side limb secured to the liner panel and with the other side limb secured to a respective end portion of the first exterior panel.

6. A wall assembly as claimed in claim 1, wherein each of the first fastening means comprises a plurality of first fastening elements, which fasten a respective end portion of the liner panel.

7. A wall assembly as claimed in claim 6, wherein the first elements comprise rivets.

8. A wall assembly as claimed in claim 7, wherein the first and second end portions of the liner panel are attached to respective first and second angle-section members, which include limbs perpendicular to the plane of the liner panel, wherein further angle-section members are arranged for attachment to the second supports and include limbs perpendicular to the plane of the liner plane, and wherein said perpendicular limbs of the angle-section members include openings and the rivets, comprising the first fastening means, are located in these openings to secure the perpendicular limbs of the further angle-section members to the corresponding perpendicular limbs of the first and second angle-section members.

9. A wall assembly as claimed in claim 8, wherein the second fastening means also comprises rivets.

10. A pressure relief wall assembly for mounting on a frame comprising a first central support, and two second supports located on either side of the first support, the pressure relief wall assembly comprising:

a liner panel having first and second end portions, and being secured at a central portion thereof to the first, central support;

first rivet means, releasably fastening the end portions of the liner panel to respective second supports, which first rivet means fail in use, when a predetermined excess pressure is applied to either side of the wall assembly;

a first exterior panel, which is secured at a central portion thereof to the first, central support and which includes first and second end portions, with the first end portion secured to the liner panel between the first end and central portions thereof and with the second end portion of the exterior panel secured to the liner panel between the second end and central portions thereof;

two second exterior panels, each of which is secured to a respective second support and includes a respective free end portion;

second rivet means, which releasably fasten said respective free end portions of the second exterior panels to one of the liner panel and a respective end portion of the first exterior panel, which second rivet means fail in use when a predetermined excess pressure is applied to either side of the wall assembly;

whereby, in use, in response to an excess pressure applied to either side of the wall assembly, the first rivet means fails to release the liner panel from the second supports and the second rivet means fail to release the free end portions of the second exterior panels, so that the liner panel and the first exterior panel deflect symmetrically about the first central support, and the second exterior panels deflect around the second supports.

11. A wall assembly as claimed in claim 10, which includes two U-section members, which secure the first and second end portions of the exterior panel to the liner panel, each of said U-shaped sections including one limb secured to the liner panel and another limb secured to the respective end portion of the exterior panel, and which further includes two angle-section members secured to the free end portions of the second exterior panels, wherein the first rivet means secures the angle-section members to the U-section members.

12. A wall assembly as claimed in claim 10 or 11, which includes two pairs of further angle-section members, with one angle-section member of each pair secured to a respective second support and with the other angle-section member of each pair secured to a respective end portion of the liner panel, and wherein the angle-section members of each pair include limbs perpendicular to the liner panel and abutting one another, with the first rivet means securing those perpendicular limbs together.

13. A pressure relief wall assembly for mounting on a frame comprising a first central support and two second supports located on either side of the first support, the pressure relief wall assembly comprising:

a liner panel having first and second end portions, and being secured at a central portion thereof to the first, central support;

respective first fastening means for end portions of the liner panel, each of which first fastening means releasably fastens one respective end portion of the liner panel to a corresponding second support, which first fastening means in use fail when a predetermined excess pressure is applied to either side of the wall assembly;

a first exterior panel, which is secured at a central portion thereof to the first, central support, and which includes first and second end portions;

a first sub-girt, which comprises a U-section member with a pair of side limbs, one side limb being secured to the liner panel betwen the first and central portions thereof and the other side limb being secured to the second end portion of the first exterior panel;

a second sub-girt, whic comprises a U-section member with a pair of side limbs, one side limb being secured to the liner panel between the second and central portions thereof and the other side limb being secured to the second end portion of the first exterior panel, two second exterior panels, each of which is secured to a respective second support and includes a respective free end portion;

two angle-section members, each of which is secured to a free end portion of a respective second exterior panel;

and two second fastening means, each of which releasably fastens a respective angle section member to a respective one of the first and second sub-girts, which second fastening means fail in use when a predetermined excess pressure is appled to either of the wall assembly;

whereby, in use, in response to an excess pressure applied to either side of the wall assembly, the liner panel and the first exterior panel are released from the second support and the second exterior panel, and deflect symmetrically about the first, central support, and the second exterior panels deflect around the second supports.

14. A wall assembly as claimed in claim 13, wherein the second elements comprise rivets.

* * * * *